US008297379B2

(12) United States Patent
Rambo

(10) Patent No.: US 8,297,379 B2
(45) Date of Patent: Oct. 30, 2012

(54) SYSTEMS AND METHODS FOR PROVIDING A GEARLESS DRILLING TURBINE

(75) Inventor: Jason W. Rambo, Greenwood, AR (US)

(73) Assignee: J-Max, Vernal, UT (US)

( * ) Notice: Subject to any disclaimer, the term of this patent is extended or adjusted under 35 U.S.C. 154(b) by 319 days.

(21) Appl. No.: 12/693,200

(22) Filed: Jan. 25, 2010

(65) Prior Publication Data

US 2011/0180329 A1 Jul. 28, 2011

(51) Int. Cl.
*E21B 4/00* (2006.01)
*E21B 4/02* (2006.01)

(52) U.S. Cl. ..... 175/107; 175/92; 175/323; 175/100

(58) Field of Classification Search ..... 175/107, 175/92, 323, 71, 100
See application file for complete search history.

(56) References Cited

U.S. PATENT DOCUMENTS

| | | | | |
|---|---|---|---|---|
| 2,336,336 | A * | 12/1943 | Zublin | 175/107 |
| 2,591,488 | A * | 4/1952 | Yost | 175/100 |
| 3,304,838 | A | 2/1967 | McDonald | |
| 3,730,016 | A * | 5/1973 | Miller | 74/424.94 |
| 4,051,909 | A | 10/1977 | Baum | |
| 4,058,163 | A | 11/1977 | Yandell | |
| 4,114,704 | A | 9/1978 | Maurer et al. | |
| 4,434,862 | A | 3/1984 | Lyons | |
| 6,520,271 | B1 | 2/2003 | Martini | |
| 7,204,326 | B2 | 4/2007 | Downie et al. | |
| 7,413,036 | B2 | 8/2008 | Law et al. | |

* cited by examiner

*Primary Examiner* — Cathleen Hutchins
(74) *Attorney, Agent, or Firm* — David B. Tingey; Kirton | McConkie

(57) ABSTRACT

A drilling sub assembly adapted to be coupled between a drill bit of a drilling rig and a drill pipe, the drilling sub assembling including a turbine unit directly coupled to the drill bit via a mandrel, such that passage of a drilling fluid through the drilling sub assembly rotates the turbine unit which in turn directly rotates the drill bit coupled thereto. The present invention further relates to a baffle for controlling and reducing debris present within a drilling fluid used in combination with the drilling sub assembly.

20 Claims, 12 Drawing Sheets

SYSTEMS AND METHODS FOR PROVIDING A GEARLESS DRILLING TURBINE

BACKGROUND OF THE INVENTION

1. Field of the Invention

The present invention relates to systems and methods for providing a hydraulic drilling sub assembly for use in the excavation, mining and drilling fields. Specifically, the present invention relates to a drilling sub assembly incorporating a hydraulically driven turbine that directly drives a drill bit without the use of gears or other mechanical means to limit the rate of rotation for the drill bit.

2. Background and Related Art

As the world becomes increasingly populated and developed, greater demands are made on the world's supply of natural resources. For example, as technology becomes increasingly accessible and affordable to third-world countries, demands for ground water, natural gas, and petroleum also increase. As a result, greater efforts have been required to recover these natural resources to meet the growing demands of the world's population. To address these challenges, the service industry must develop new technology while improving existing products to provide economical solutions to efficiently tap deep reservoirs of natural resources.

Hydraulic drilling is the process of using turbines to rotate a drill bit. As a drilling fluid is passed over the turbine, the turbine is rotated thereby causing the drill bit to rotate. Typically, a drilling fluid is delivered to the turbine via a string of drill pipes extending from the surface to the turbine. There are many types of drilling fluids including air, air and water, air and polymer, water, water-based mud, oil based mud, and synthetic-based fluid. On a drilling rig, drilling fluid (sometimes referred to as mud) is pumped from mud pits through the drill string where it sprays out of nozzles on the drill bit, cleaning and cooling the drill bit in the process. The mud then carries the crushed or cut rock up the annular space between the drill string and the sides of the hole being drilled. These cuttings are then driven up through the surface case where they emerge back at the surface.

The rate of rotation for the drill bit is commonly controlled by incorporating reducer gears between the turbine and the drill bit. In this way, one can select the speed of the bit by selecting an appropriate gear ratio for a given application. However, several difficulties exist with this method of speed control.

For example, reducer gears are commonly exposed to sediments and other debris found in the drilling fluid. Debris within the drilling fluid can become lodged within the reducer gears causing jams and other malfunctions that must be cleared. The process of clearing these jams are time consuming, expensive and potentially damaging to the drilling equipment. Furthermore, in the event that the drill bit becomes jammed while cutting the rock, the inclusion of reducer gears prevents the drill bit from spinning freely in a direction opposite to the jam. Accordingly, the process of undoing the jam results in downtime and may result in damage to the drill bit and other components of the drilling string.

Thus, while techniques currently exist for hydraulic drilling applications, challenges still exist with such techniques. Accordingly, it would be an improvement in the art to augment or even replace current techniques with other techniques.

BRIEF SUMMARY OF THE INVENTION

The present invention relates to systems and methods for providing a hydraulic drilling sub assembly for use in the excavation, mining and drilling fields. Specifically, the present invention relates to a drilling sub assembly incorporating a hydraulically driven turbine that directly drives a drill bit without the use of gears or other mechanical means to limit the rate of rotation for the drill bit.

In some implementations of the present invention, a drilling sub assembly is provided as a means for converting an upstream drilling fluid into a rotational force that directly drives a drill bit. Thus, in some implementations the drilling sub assembly is interposedly coupled between a string of drill pipes and a drill bit.

The drilling sub assembly generally includes an upper component, a mid component and a lower component, each component having an internal space through which a drilling fluid is capable of flowing. The upper component includes a body casing having an internal lumen for housing a baffle and a turbine unit. The baffle includes a fluid channel through which drilling fluid is directed and applied directly to the turbine unit. The position of the baffle is maintained within the internal lumen such that the baffle is prevented from rotating within the internal lumen. However, a bearing is interposed between the baffle and the turbine unit such that the turbine unit is permitted to rotate relative to the baffle. Thus, as the drilling fluid leaves the baffle and contacts the turbine unit, the turbine unit rotates freely relative to the fixed position of the baffle and body casing.

The mid component includes a bearing housing having a plurality of bearing surfaces for supporting various bearing units. The bearing housing is threadedly coupled to the body casing such that a first bearing unit is interposedly positioned between the bearing housing and the turbine unit.

The lower component includes a mandrel having a base from which extends a shaft. The shaft is extends through the bearing housing and is threadedly coupled to the turbine unit. A second bearing unit is interposedly positioned between the base portion of the mandrel and the bearing housing. The interposing second bearing unit thereby permits the mandrel to rotate freely relative to the fixed position of the bearing housing. Thus, as the drilling fluid rotates the turbine unit, the direct coupling between the turbine unit and the mandrel causing the mandrel to rotate at the same rate as the turbine unit.

A free end of the body casing includes a set of threads for threadedly coupling the drilling sub assembly to an upstream drill pipe. Furthermore, a free end of the mandrel includes a set of threads for threadedly coupling a drill bit. Thus, as the drilling fluid flows through the baffle and over the turbine unit, the turbine unit and coupled mandrel rotate thereby rotating the coupled drill bit relative to the fixed positions of the drill pip, the body casing, the baffle and the bearing housing.

BRIEF DESCRIPTION OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. These drawings depict only typical embodiments of the invention and are not therefore to be considered to limit the scope of the invention.

DETAILED DESCRIPTION OF THE INVENTION

The presently preferred embodiments of the present invention will be best understood by reference to the drawings, wherein like reference numbers indicate identical or functionally similar elements. It will be readily understood that the components of the present invention, as generally described and illustrated in the figures herein, could be arranged and designed in a wide variety of different configurations. Thus, the following more detailed description, as represented in the figures, is not intended to limit the scope of the invention as claimed, but is merely representative of presently preferred embodiments of the invention.

Figure 1:
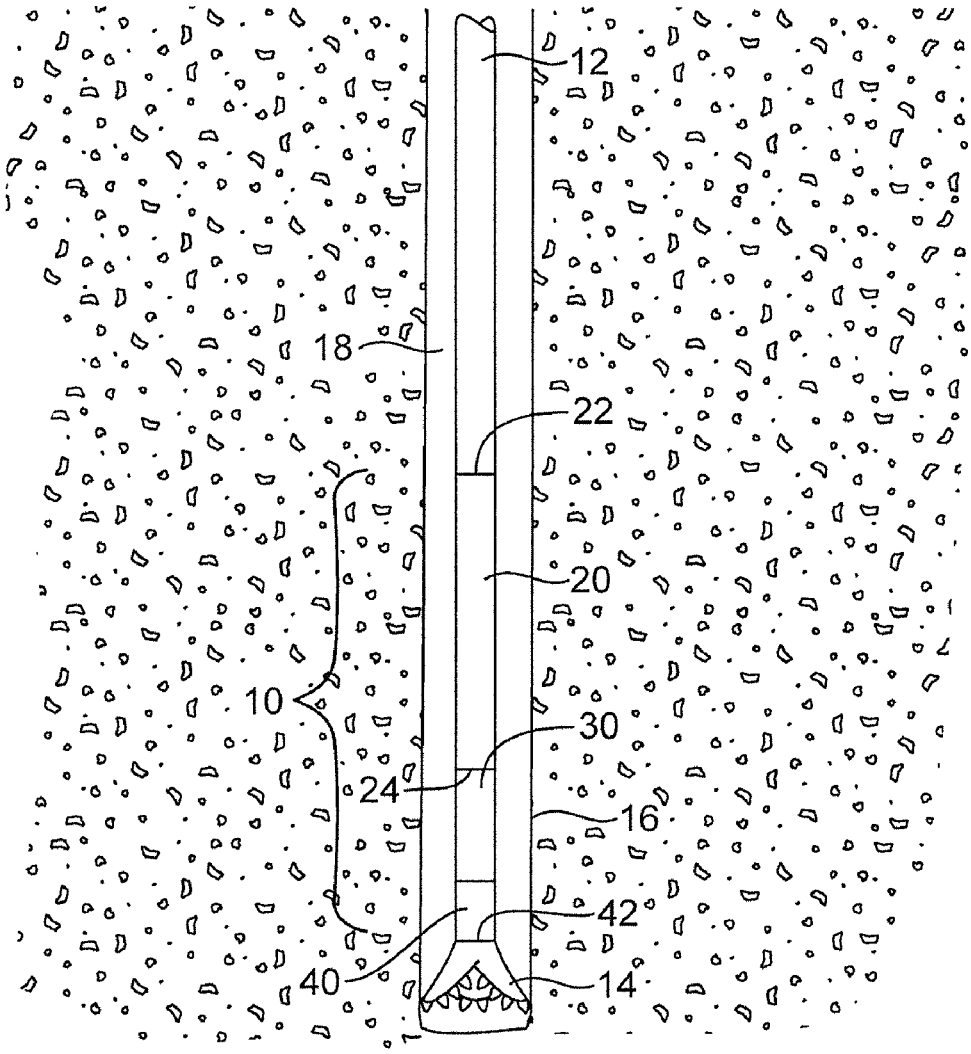
FIG. 1 is a perspective view of a drilling rig assembly incorporating a drilling sub assembly in accordance with a representative embodiment of the present invention.

Referring now to FIG. 1, an implementation of a drilling sub assembly 10 is shown as interposedly coupled between a drill pipe 12 and a drill bit 14. The drill pipe 12 generally includes an elongate tubular member having an internal lumen for transferring a drilling fluid from the surface to the drill bit 14. The drill bit 14 generally includes a drill bit or another known cutting surface configured to cut a borehole 16. In some embodiments, the drill bit 14 further includes a fluid outlet whereby drilling fluid is released through the drill bit 14 to assist in removing debris from the borehole 16. The debris are removed to the surface via the interstitial space 18 between the drill pipe 12 and the borehole 16, as is known in the art.

In general, the drilling sub assembly 10 is provided as a means for converting the flow of drilling fluid into a rotational force at the drill bit 14. Specifically, the drilling sub assembly 10 utilizes a turbine unit to convert the linear flow of drilling fluid into a rotational force needed to rotate the drill bit 14.

Some embodiments of the drilling sub assembly 10 comprise a modular unit having a plurality of interconnected sections. Each section is configured to work compatibly with the remaining sections to achieve desired working conditions for the drill bit 14. For example, in some embodiments the drilling sub assembly 10 includes an upper component 20, a mid component 30 and a lower component 40. The upper component 20 generally comprises a body casing having a first end 22 for threadedly coupling the drill pipe 12. The upper component 20 further comprises a second end 24 for threadedly coupling the mid component 30 or bearing housing of the drilling sub 10.

The bearing housing 30 houses various bearing units to permit free rotation of the lower component 40 or mandrel relative to the stationary drill pipe 12, body casing 20 and bearing housing 30. The mandrel 40 comprises a threaded end 42 for coupling the drill bit 14. Thus, the various components 20, 30 and 40 of the drilling sub assembly 10 are configured to achieve gearless rotation of the drill bit 14, as further described below.

Figure 2:
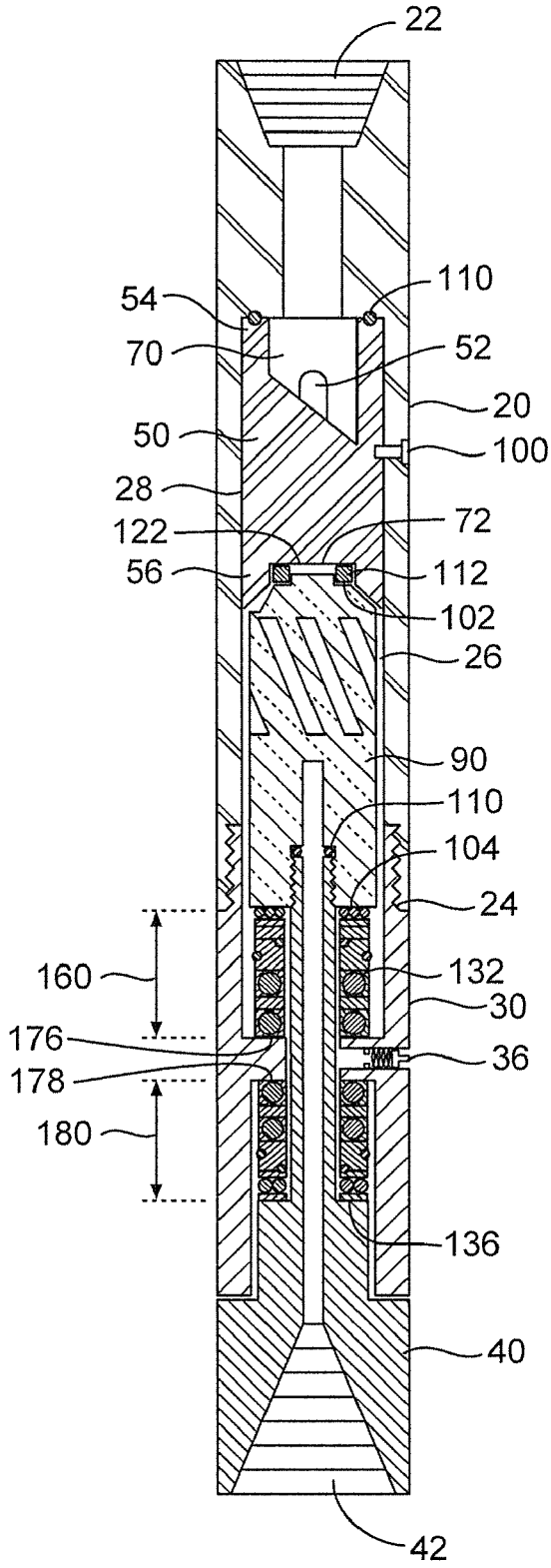
FIG. 2 is a cross-section view of a drilling sub assembly in accordance with a representative embodiment of the present invention.
Figure 3:
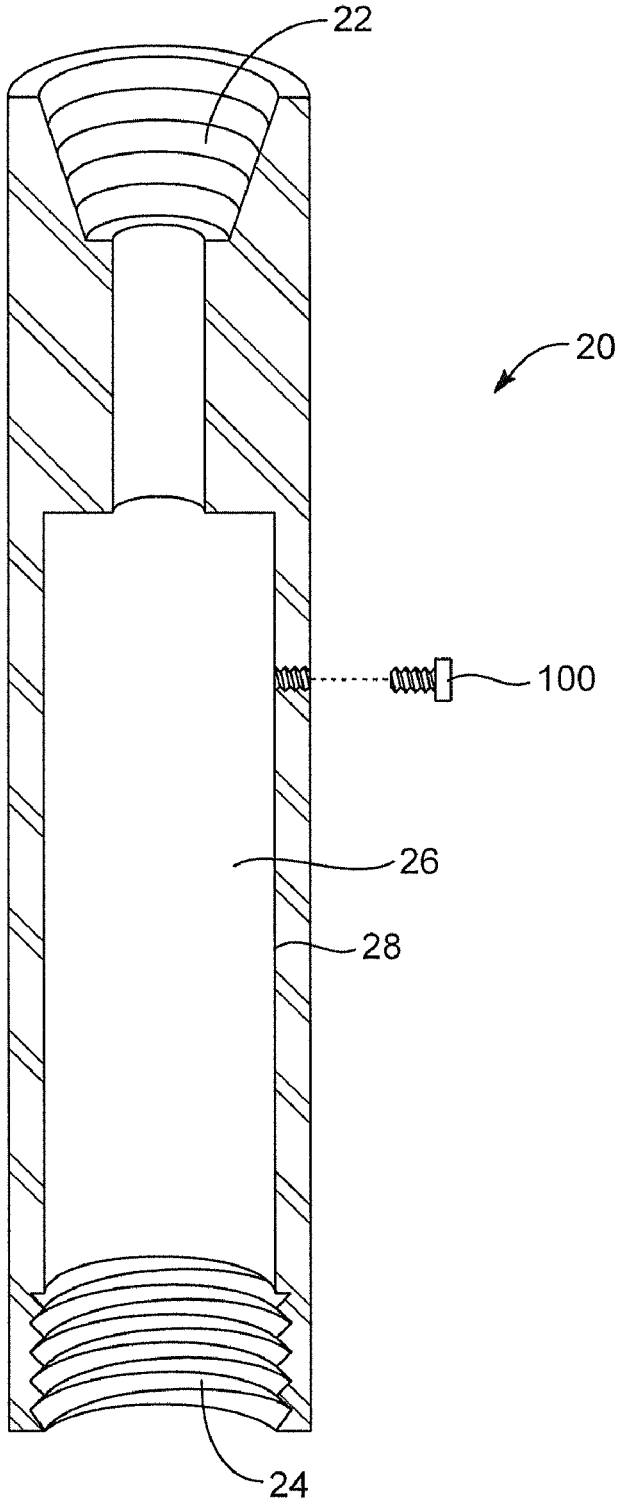
FIG. 3 is a cross-section view of body casing in accordance with a representative embodiment of the present invention.

Referring now to FIG. 2, a cross-section view of the drilling sub assembly 10 is shown, as isolated from the drill pipe and the drill bit. The upper component 20 or body casing generally comprises an elongate tubular member having an internal lumen 26, as shown in FIGS. 2 and 3. The internal lumen 26 is generally configured to include various diameters to receive internal components of the sub assembly 10. For example, in some embodiments the internal lumen 26 houses a baffle 50 adjacent to the first end 22 opening. The baffle 50 generally comprises a plug having a fluid channel 52 for directing and focusing a drilling fluid to selectively interact with downstream internal components. The position of the baffle 50 within the internal lumen 26 is generally maintained via a set screw 100. Set screw 100 not only maintains the vertical position of baffle 50, but also prevents baffle 50 from rotating relative to the body casing 20. In some embodiments, a plurality of set screws 100 is provided to maintain the position of baffle 50. In other embodiment, an o-ring 110 or other means for sealing is further interposed between the baffle 50 and the internal lumen 26 to prevent drilling fluid from bypassing the baffle 50.

Figure 4A:
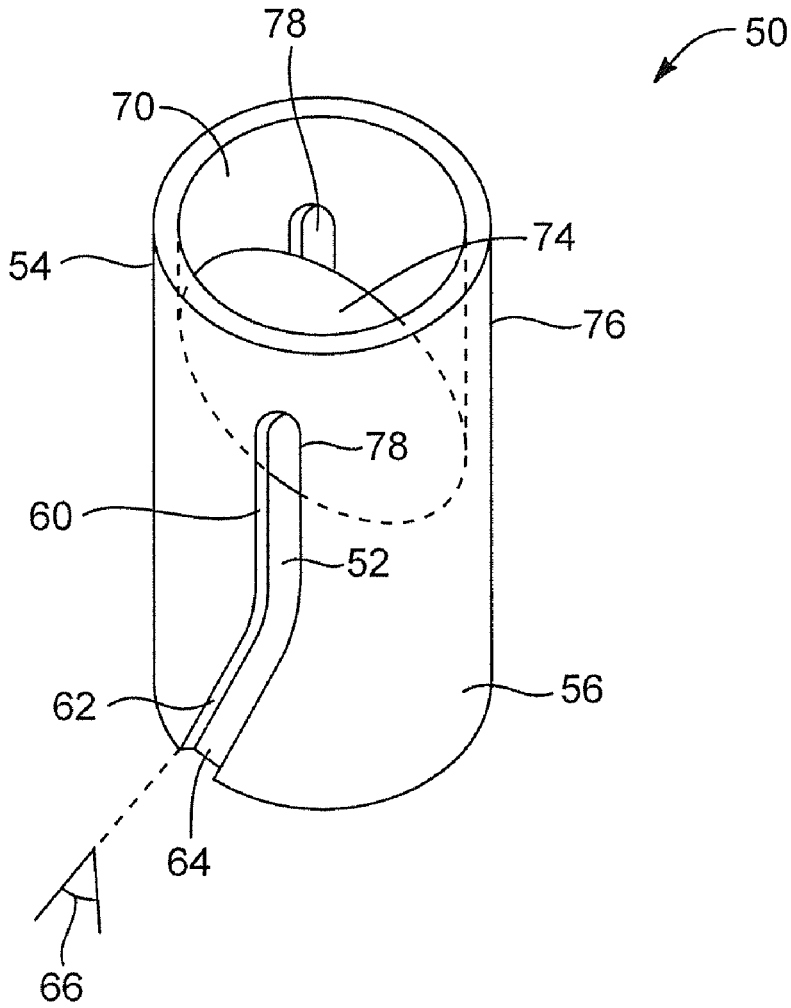
FIG. 4A is a perspective view of a baffle in accordance with a representative embodiment of the present invention.
Figure 4B:
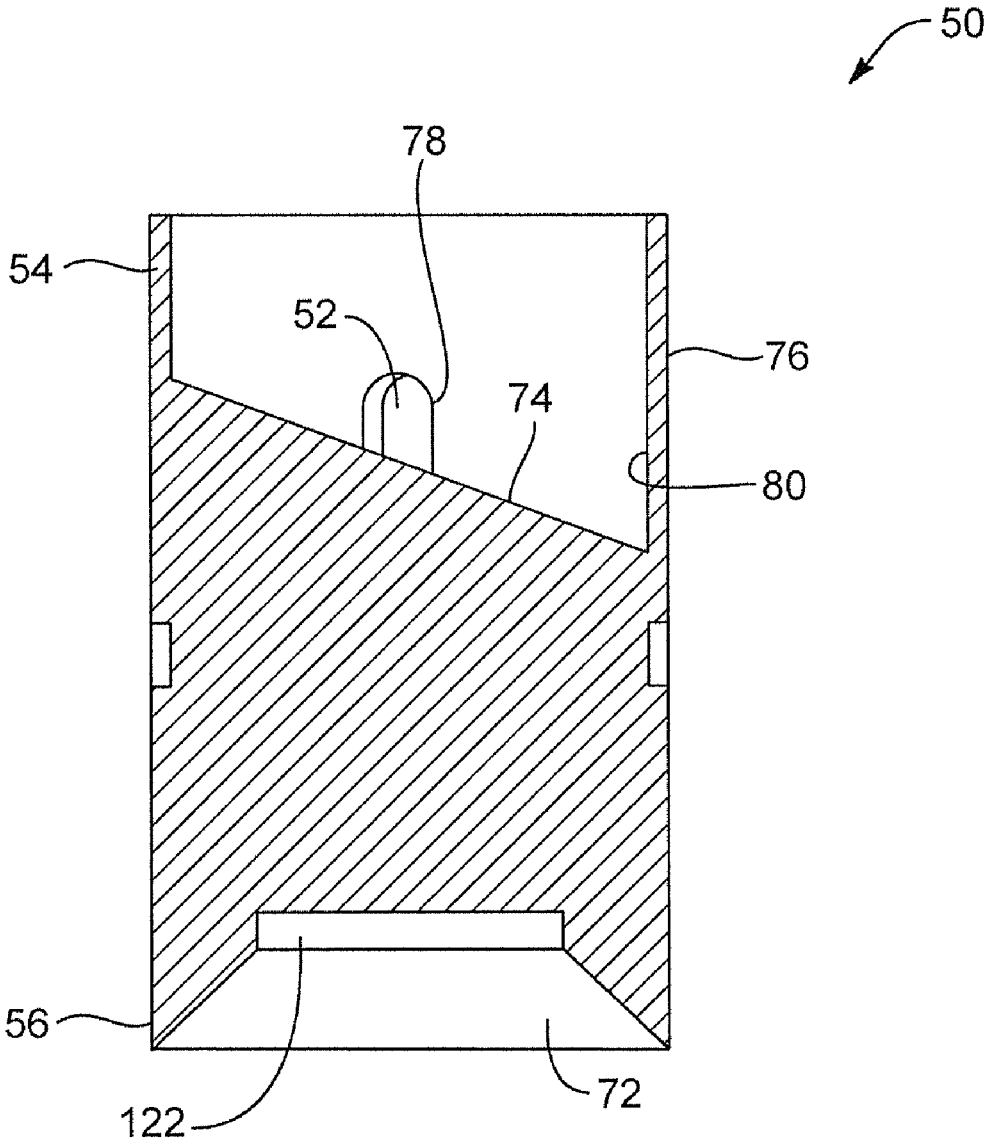
FIG. 4B is a cross-section view of a baffle in accordance with a representative embodiment of the present invention.
Figure 5A:
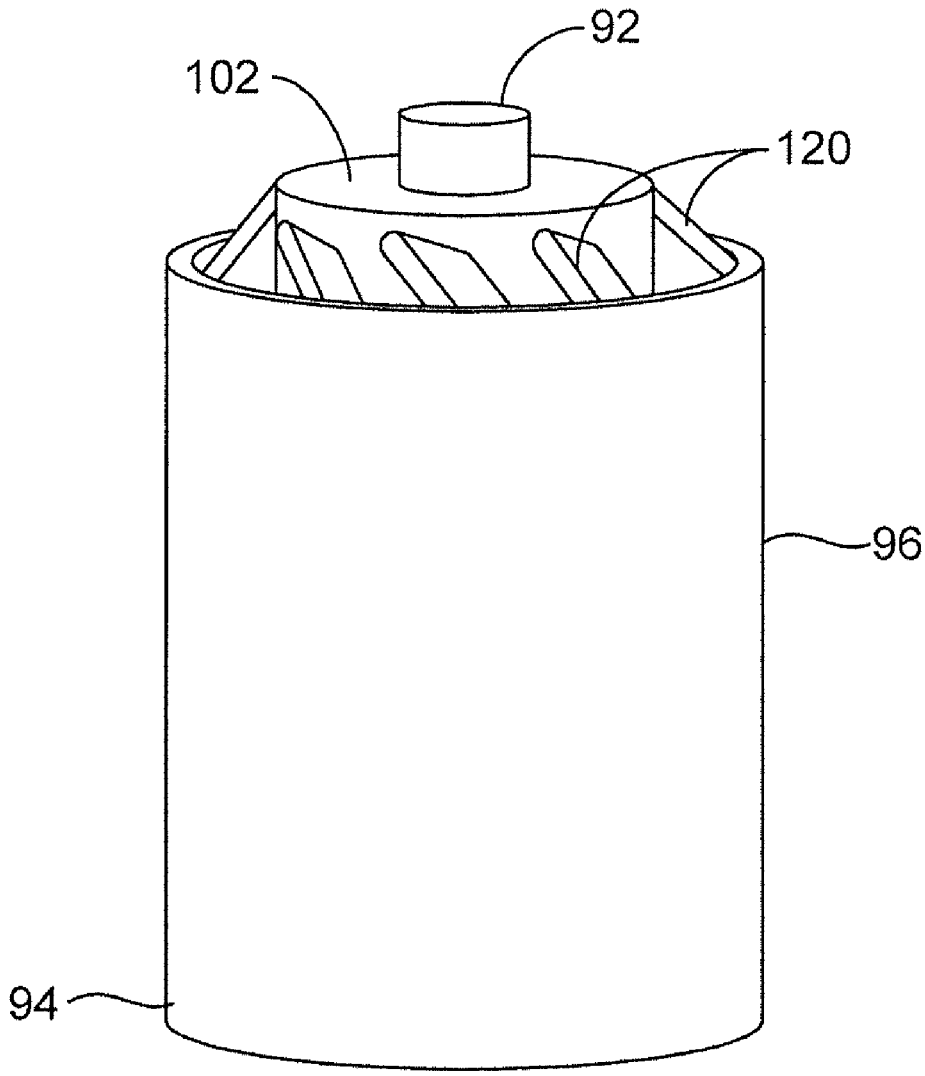
FIG. 5A is a perspective view of a turbine unit in accordance with a representative embodiment of the present invention.
Figure 5B:
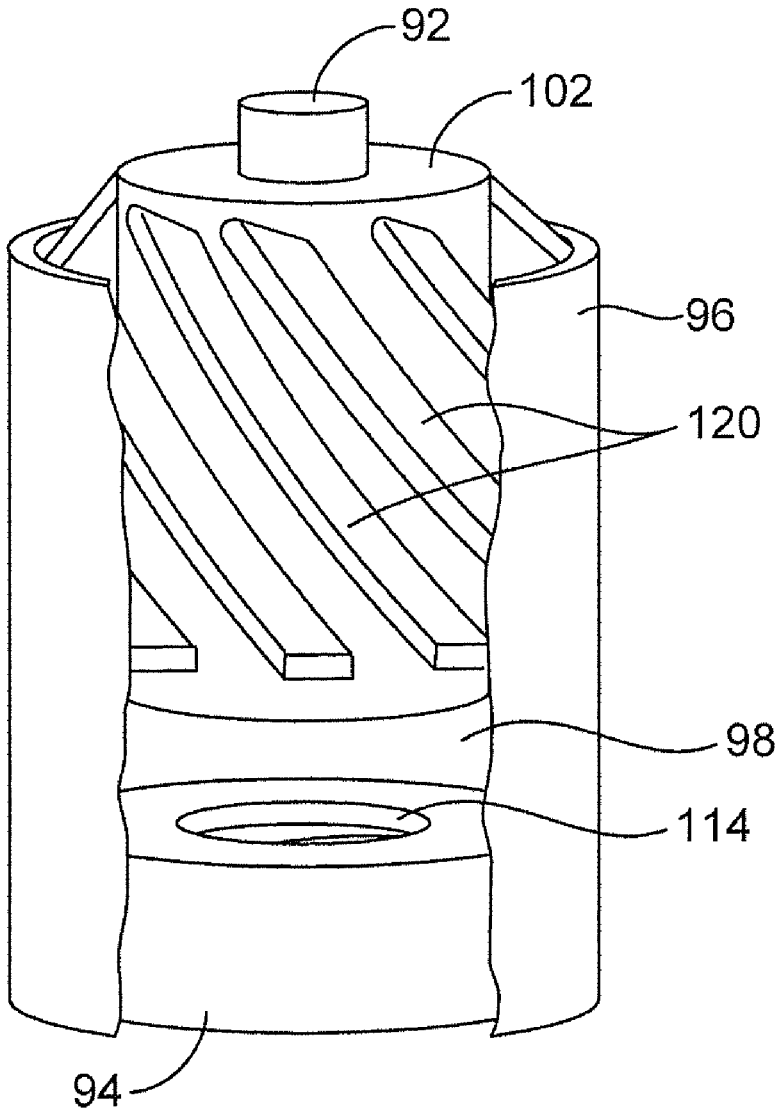
FIG. 5B is a partial cross-section view of a turbine unit in accordance with a representative embodiment of the present invention.
Figure 5C:
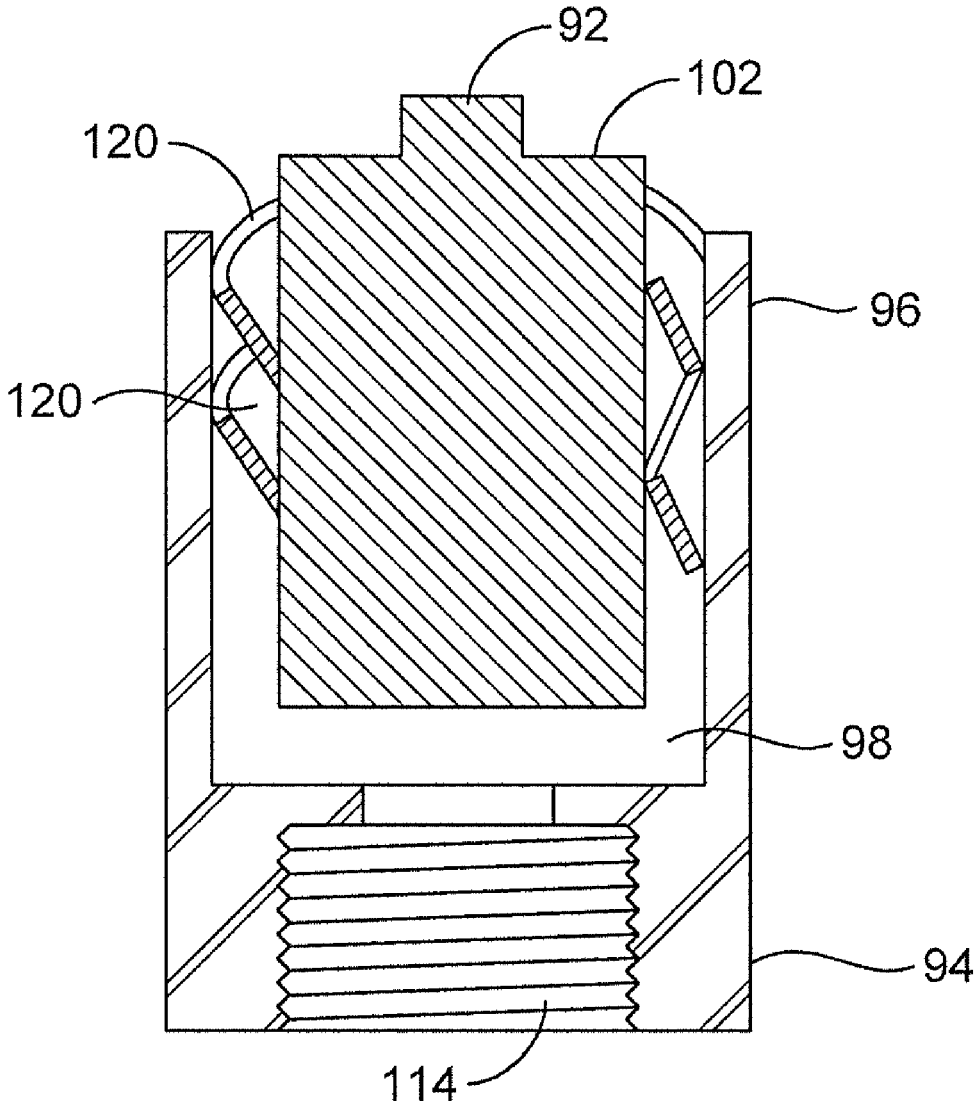
FIG. 5C is a cross-section view of a turbine unit in accordance with a representative embodiment of the present invention.

Baffle 50 comprises a first end 54 and a second end 56, as shown in FIGS. 2, 4A and 4B. The first end 54 comprises an upper chamber 70 for receiving an upstream drilling fluid. The upper chamber 70 is generally cylindrical having a bottom surface 74 that is slanted or oblique relative to the vertical walls 76 of the chamber 70. The upper chamber 70 further includes a plurality of windows 78 in fluid communication with fluid channel 52. Fluid channel 52 generally comprises a groove on the external surface of baffle 50, wherein the inner surface 28 of the internal lumen 26 combines with the groove to complete the fluid channel 52. Thus, the out diameter of baffle 50 is selected to minimize any tolerance between the baffle 50 and the inner surface 28 of the body casing 20.

In some embodiments, fluid channel 52 comprises a first portion 60 and a second portion 62, as shown in FIG. 4A. First portion 60 is generally vertically oriented. However, second portion 62 is generally angled thereby redirecting the flow of the drilling fluid. The combined features of first and second portion 60 and 62 thereby provide means for directing the drilling fluid to selectively interact with a downstream internal component. In some embodiments, first portion 60 is angled to be aligned with second portion 62. In other embodiments, second portion 62 is aligned vertically with first portion 60. Still further, in other embodiments baffle 50 comprises more than two fluid channels 52.

The slanted configuration of bottom surface 74 naturally provides the upper chamber 70 with varying depths. The portion of the upper chamber 70 having the greatest depth experiences aberrant currents as the drilling fluid flows down the slanted surface into the vertical interior wall 80. In particular, drilling fluid within this portion of the upper chamber 70 experiences eddies that churn and otherwise mix the drilling fluid.

In some embodiments, unwanted debris within the drilling fluid gravitate to this portion of the upper chamber 70 where they are subjected to aberrant currents that reduce the size and/or trap the unwanted debris. Eventually, the unwanted debris is sufficiently reduced in size and thereby released from the aberrant current and permitted to exit the upper chamber 70 via the window 78. In some embodiments, the dimensions of window 78 are selected to prevent passage of unwanted debris having a size sufficient to harm or jam downstream internal components. Accordingly, the combined features of the slanted bottom surface 74 and the plurality of windows 78 prevents jams and other malfunctions due to debris in the drilling fluid.

The second end 56 of baffle 50 comprises a lower chamber 72 for rotatably receiving a downstream internal component. In particular, lower chamber 72 comprises a recess for compatibly receiving a first end 92 of a turbine unit 90, as shown in FIGS. 2 and 5A-5C.

Turbine unit 90 generally comprises a cylindrical body having an outer sleeve 96 and an internal lumen 98. A plurality of blades 120 is set within the internal lumen 98 whereby a drilling fluid is permitted to pass over the blades 120 and through the internal lumen 98. The turbine unit 90 is positioned within the recess of the lower chamber 72 of the baffle 50 such that an outlet 64 of the fluid channel 52 (see FIG. 4A) guides the drilling fluid to directly contact the plurality of blades 120. Thus, in some embodiments the second portion 62 of the fluid channel 52 is positioned at an angle 66 to achieve a desired contact between the drilling fluid and the plurality of blades 120. For example, in some embodiments angle 66 is selected to be 90° to the plurality of blades 120. In other embodiments, angle 66 is selected to be less than or greater than 90° to the plurality of blades 120.

A second end 94 of the turbine unit 90 comprises a threaded opening 114 through which the drilling fluid exits the internal lumen 98. As the drilling fluid passes over the blades 120, the turbine unit 90 is activated resulting in rotation of unit 90.

The first end 92 of the turbine unit 90 further includes a bearing surface 102 for supporting a bearing unit 112, such as a sealed bearing. A complimentary bearing surface 122 is located in lower chamber 72 of baffle 50. Thus, bearing unit 112 permits free rotation of turbine unit 90 relative to the stationary positions of baffle 50 and body casing 20.

Figure 6:
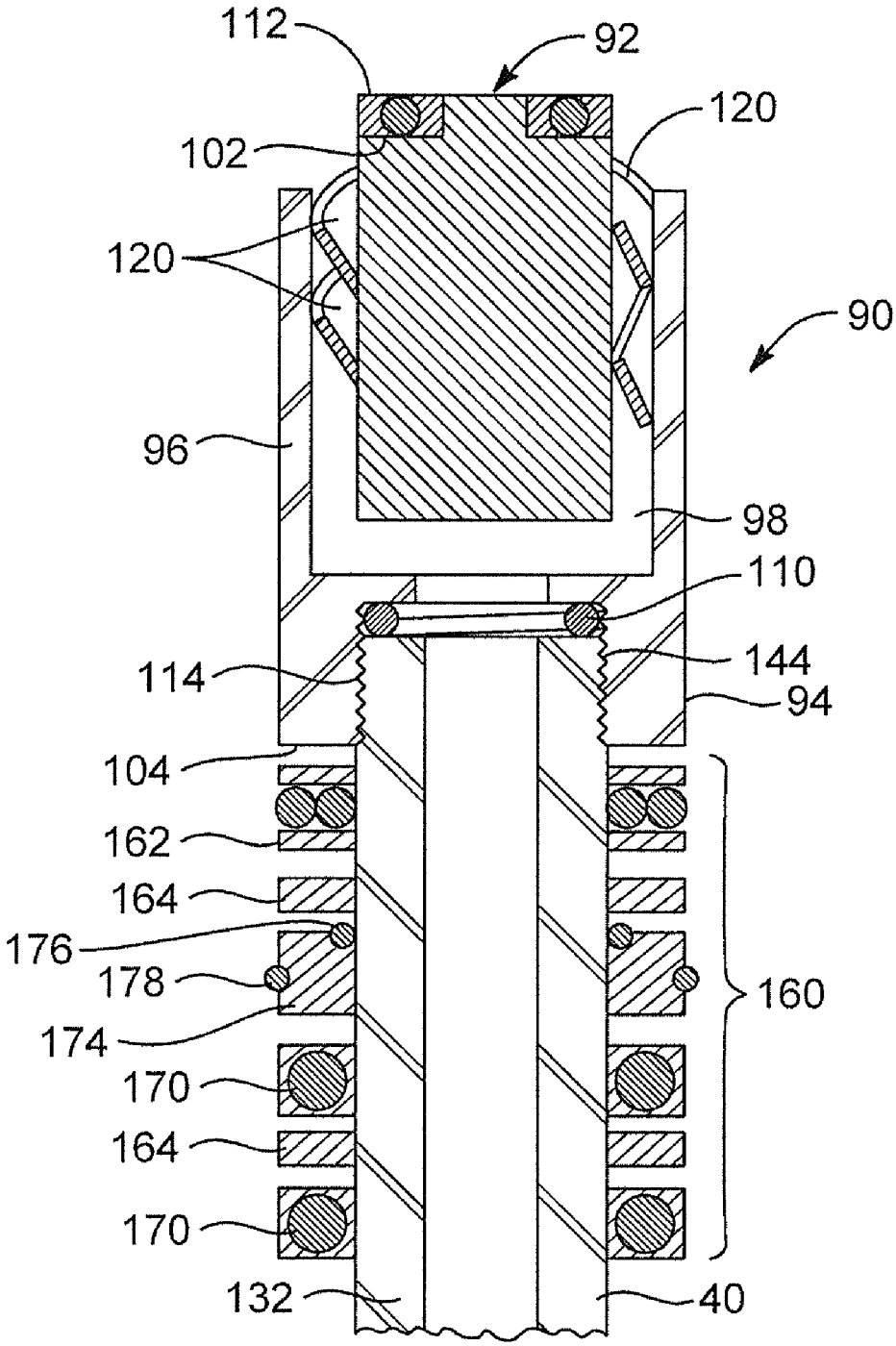
FIG. 6 is a cross-section view of a turbine unit threadedly coupled to a mandrel and a first bearing unit in accordance with a representative embodiment of the present invention.
Figure 7:
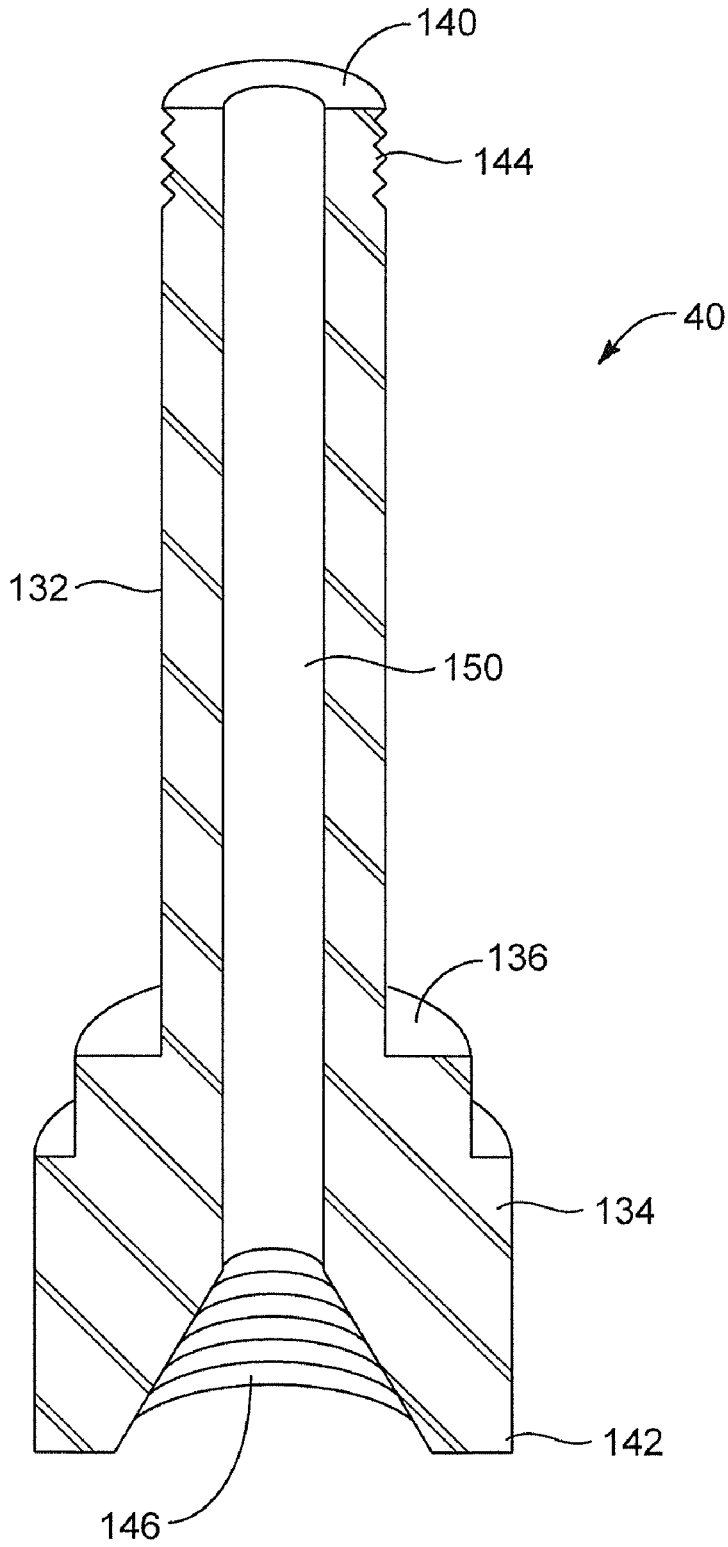
FIG. 7 is a cross-section view of a mandrel in accordance with a representative embodiment of the present invention.
Figure 8:
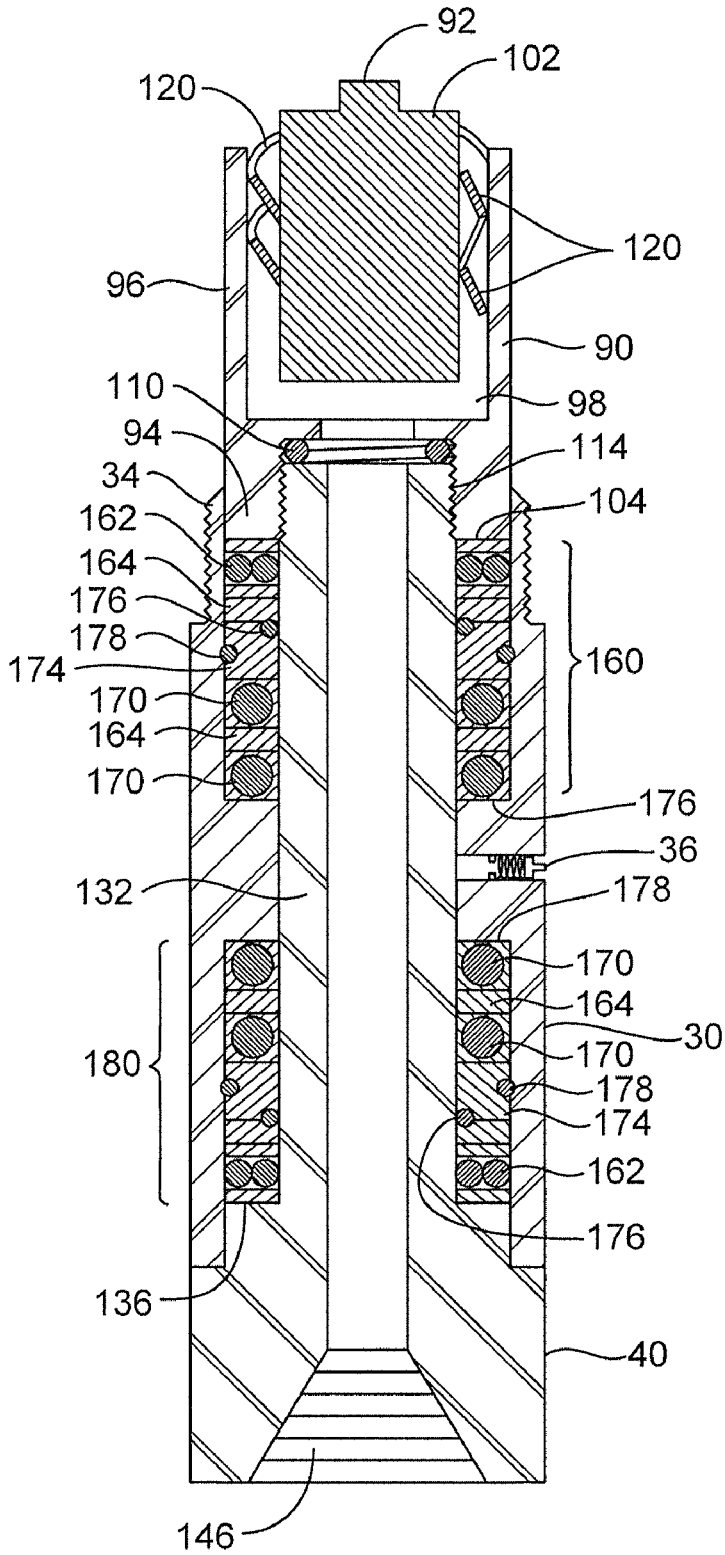
FIG. 8 is a cross-section view of a partially assembled drilling sub assembly in accordance with a representative embodiment of the present invention.
Figure 9:
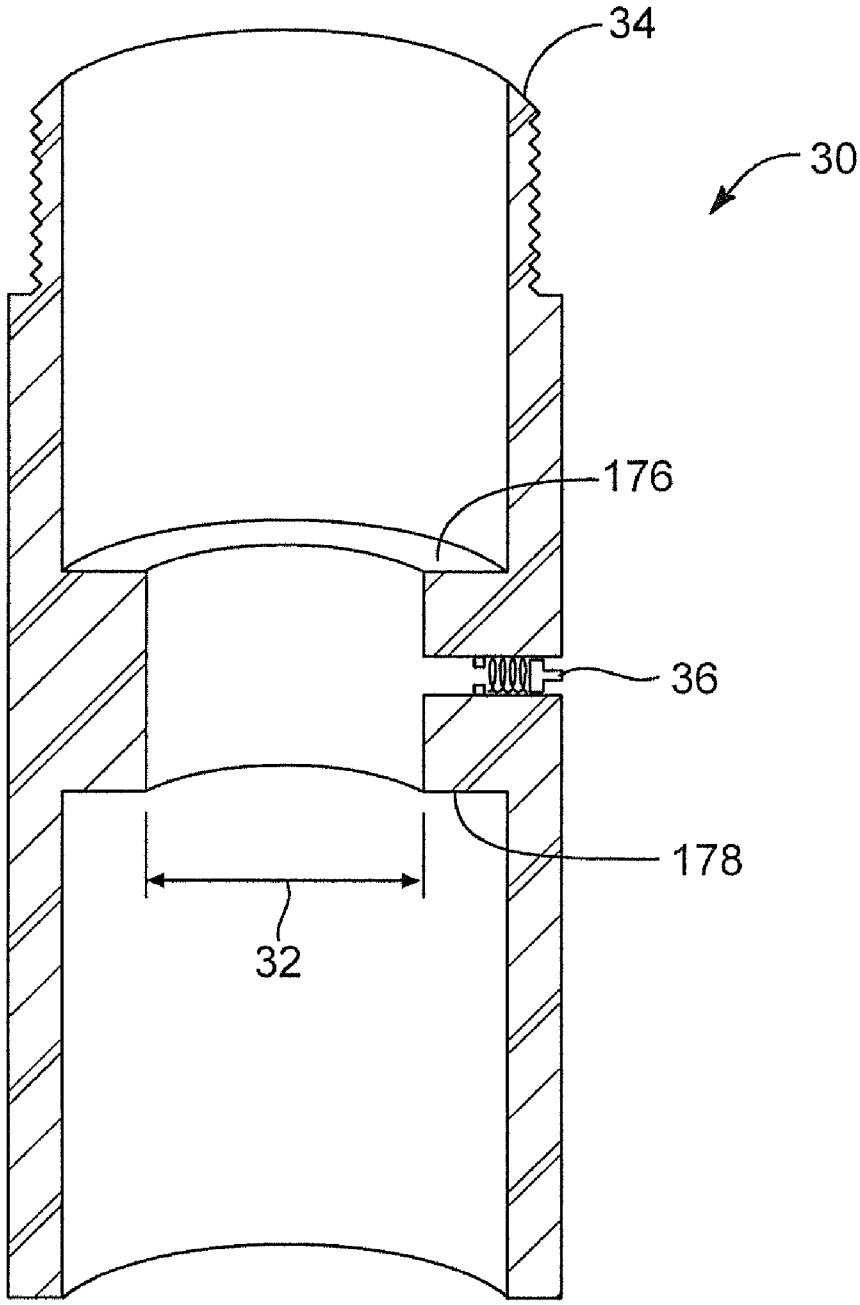
FIG. 9 is a cross-section view of a bearing housing in accordance with a representative embodiment of the present invention.

Referring now to FIGS. 6, 7 and 8, threaded opening 114 of turbine unit 90 is further configured to threadedly receive a shaft portion 132 of mandrel 40. Mandrel 40 generally comprises a tubular member having a first end 140, a second end 142 and a fluid pathway 150 extending therebetween. First end 140 comprises an elongate shaft having a set of external threads 144 to threadedly couple threaded opening 114 of turbine unit 90. Once coupled, fluid pathway 150 and internal lumen 98 are in fluid communication. In some embodiments, an o-ring 110 or other sealing means is interposed between mandrel 40 and turbine unit 90 to contain the flow of drilling fluid to within the internal pathways 26, 70, 78, 52, 98 and 150 of the assembly 10.

Second end 142 comprises a stepped base having a set of internal threads 146 to threadedly couple a drill bit 14. The stepped configuration provides various horizontal surfaces which act to support various components of the assembly 10, discussed in detail below.

With reference to FIGS. 6 and 8, the outer diameter of shaft portion 132 is selected to receive a first bearing unit 160. Bearing unit 160 is provided to permit free rotation of turbine unit 90 and mandrel 40 relative to the stationary positions of body casing 20 (not shown) and bearing housing 30. Thus, in some embodiments the second end 94 of turbine unit 90 comprises a generally horizontal bearing surface 104 to receive and support bearing unit 160.

Bearing unit 160 may include any combination of bearings, spacers, sealing means, grommets, o-rings, and the like as known and commonly used in the art. In some embodiments, bearing unit 160 comprises a combination of various units including thrust bearings 162, spacers 164, and sealed bearings 170. In other embodiments, bearing unit 160 further comprises a spacer 174 having a plurality of recesses to receive various o-rings, such as a Teflon® o-ring 176 and a rubber o-ring 178. Thus, the combination of various units provides a bearing unit 160 configured to allow turbine unit 90 and mandrel 40 to freely rotate within the drilling sub assembly 10.

Referring now to FIGS. 6-9, bearing housing 30 generally comprises a tubular member having an inner diameter 32 configured to rotatably receive shaft 132 of mandrel 40. A first end 34 of bearing housing 30 comprises a set of threads for threadedly coupling the second end 24 of body casing 20. The inner lumen of bearing housing 30 further includes an upper bearing surface 176 and a lower bearing surface 178 configured to support both the first bearing unit 160 and a second bearing unit 180, respectively. In some embodiments, the second bearing unit 180 comprises a combination of various bearing units, similar to those described in connection with the first bearing unit 160, above. The second bearing unit 180 is seated over shaft 132 of mandrel 40 such that the second bearing unit 180 is interposed between bearing surface 136 of mandrel 40 and lower bearing surface 178 of bearing housing 30.

The first and second bearing units 160 and 180 are selectively set to a desired thrust load by threadedly coupling, to a desired torque, the turbine unit 90 and the mandrel 40. One of skill in the art will appreciate that variations in the size, type and configuration of the bearing units will necessarily alter the required thrust load. In some embodiments, the desired thrust load of the bearing units is maintained by locking the threaded relationship between the turbine unit 90 and the mandrel 40 via a thread-lock material. In other embodiments, the threaded relationship between the turbine unit 90 and the mandrel 40 is maintained via a tack weld or a set screw (not shown).

The bearing unit 112 interposed between the turbine unit 90 and baffle 50 is set to a desired thrust load by threadedly coupling, to a desired torque, the bearing housing 30 and the body casing 20. Thus, the first and second bearing units 160 and 180, and bearing unit 112 are capable of being independently adjusted to desired thrust loads, as may be required by the individual bearing unit configurations.

In some embodiments, bearing housing 30 further comprises a valve 36. Valve 36 is generally provided as a means for accessing the first and second bearing units 160 and 180 following assembly of the drilling sub device 10. In some embodiments, valve 36 comprises a grease port whereby a lubricant is injected into the bearing housing 30 via valve 36. Thus, valve 36 provides a means whereby the first and second bearing units 160 and 180 are capable of being repacked with a lubricant following use of the assembly 10. In some embodiments, bearing housing 30 further comprises a second valve (not shown) to permit exchange of spent lubricant within the housing 30 during the process of injecting new lubricant via valve 36.

Referring generally to the various Figures discussed above, of particular interest to the present invention is the lack of gears or other means for controlling the direction and/or speed of turbine unit 90. In some embodiments of the present invention, the rate of rotation for the turbine unit 90 is directly proportional to the flow rate of drilling fluid through the drilling sub assembly 10. Thus, the speed of the turbine unit 90 may be variably adjusted by increasing or decreasing the flow rate of the drilling fluid. In some embodiments, the flow rate of the drilling fluid is controlled by adjusting a pump or flow regulator associated with the drilling fluid. In other embodiments, the flow rate of the drilling fluid is adjusted by modifying the features of baffle 50.

For example, in some embodiments baffle 50 is modified to include an increased number of windows 78 and fluid channels 52, thereby increasing the flow rate of the drilling fluid through the drilling sub assembly 10. In other embodiments, baffle 50 is modified to include fewer windows 78 and fluid channels 52, thereby decreasing the flow rate of the drilling fluid through the drilling sub assembly 10. In some embodiments, the dimensions of fluid channels 52 are modified to increase or decrease the flow rate of the drilling fluid through the baffle 50. Finally, in some embodiments fluid channel 52 is tapered to accelerate the flow rate of the drilling fluid as it exits baffle 50.

The absence of gears within the present invention eliminates the possibility of damage to the drilling sub assembly 10 in the event of an internal or external jam. For example, should the turbine unit 90 jam due to the presence of debris within the drilling fluid, the turbine unit 90 would simply cease to rotate. The drilling fluid would continue to bypass the turbine unit 90 until either the debris was dislodged by the drilling fluid, or the jam was physically removed. Similarly, in the event of the drill bit 14 becoming jammed, the turbine unit 90, the mandrel 40 and the drill bit 14 would simply cease rotating. Accordingly, an operator would back the drill bit 14 away from the jam thereby permitting the turbine unit 90, the mandrel 40 and the drill bit 14 to recover their rotation. The operator would then resume the drilling operation.

The drilling sub assembly 10 of the present invention is generally assembled by first positioning baffle 50 within body casing 20. In some embodiments, o-ring 110 is first within internal lumen 26 so as to be interposed between baffle 50 and the abutting surface of the body casing 20. Once in place, baffle 50 is secured via set screw 100 thereby preventing further movement or rotation of baffle 50.

Prior to coupling the body casing 20 to the bearing housing 30, the turbine unit 90, the bearing housing 30, the bearing units 160 and 180, and the mandrel 40 are preassembled, as shown in FIG. 8. In particular, the second bearing unit 180 is first placed on bearing surface 136 of the mandrel 40. Mandrel 40 and bearing unit 180 are then inserted into bearing unit 30 such that bearing unit 180 is seated against lower bearing surface 178. First bearing unit 160 is then placed over shaft 132 of mandrel 40 such that bearing unit 160 is seated against upper bearing surface 176. Mandrel 40 is then threadedly coupled to turbine unit 90, such that o-ring 110 is interposed between threaded opening 114 and first end 140 of mandrel 40. The mandrel 40 and turbine unit 90 are threadedly coupled to a desired torque so as to achieve a desired thrust load for the first and second bearing units 160 and 180.

The final step in assembly is to threadedly couple the bearing housing 30 to the body casing 20. Bearing unit 112 is first positioned on the first end 92 of turbine unit 90. Turbine unit 90 is then inserted into the internal lumen 26 of the body casing 20. Bearing housing 30 is then threadedly coupled to body casing 20 until bearing unit 112 is seated in within lower chamber 72 of baffle 50. Bearing housing 30 and body casing 20 are threadedly coupled to a desired torque so as to achieve a desired thrust load for bearing unit 112.

The present invention may be embodied in other specific forms without departing from its structures, methods, or other essential characteristics as broadly described herein and claimed hereinafter. Thus, the described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A drilling sub assembly adapted to be coupled between a drill bit of a drilling rig and a drill pipe, the drilling sub assembly comprising:

a body casing having a first end, a second end and an internal lumen, the first end being threadedly couplable to the drill pipe, and the internal lumen rotatably receiving (i) a baffle having an upper chamber and a lower chamber and (ii) a turbine unit, wherein the turbine unit comprises a complimentary surface that is received by and terminates in the baffle's lower chamber;

a bearing housing having a first end threadedly coupled to the second end of the body casing, the first end further having a recess to receive a first bearing unit, the first bearing unit being interposedly positioned between the turbine unit and the recess, a second end of the bearing housing having a recess to receive a second bearing unit; and a mandrel having a base and a shaft, the shaft extending outwardly from the base, the shaft being rotatably inserted through the bearing housing to threadedly couple with the turbine unit, the second bearing unit being interposedly positioned between the base and the recess of the second end of the bearing housing, a portion of the base being threadedly coupled to the drill bit, wherein a fluid pathway is provided through the drilling sub assembly such that flow of a drilling fluid though the fluid pathway activates the turbine unit to cause activation of the drill bit.

2. The assembly of claim 1, further comprising a third bearing unit interposedly positioned between the complimentary surface of the turbine unit and the baffle's lower chamber.

3. The assembly of claim 1, wherein the baffle further comprises a fluid channel for directing the drilling fluid to activate the turbine unit.

4. The assembly of claim 3, wherein the turbine unit comprises a plurality of blades, wherein the baffle comprises a window in fluid communication with the fluid channel, and wherein the drilling fluid flows into the window, through the fluid channel, and over the blades to activate the turbine unit.

5. The assembly of claim 1, wherein the first and second bearing units comprise at least one of a sealed bearing, a thrust bearing, a spacer, and an o-ring.

6. The assembly of claim 3, wherein the fluid pathway provides the drilling fluid with a substantially unidirectional flow through the turbine unit and out of the drill bit.

7. The assembly of claim 6, further comprising a third bearing unit interposedly positioned between the turbine unit and the lower chamber.

8. The assembly of claim 1, wherein the upper chamber comprises a vessel for receiving the drilling fluid and directing the drilling fluid through a fluid channel to the turbine unit, and wherein a bottom surface of the vessel is oblique to an inner wall surface of the upper chamber.

9. The assembly of claim 3, wherein the fluid channel comprises a first portion and a second portion, the first portion being generally parallel to an axis of rotation of the turbine unit, the second portion being oblique to the first portion.

10. A sub assembly drilling device, comprising:

an external stator housing comprising a body casing threadedly coupled to a bearing housing, the body casing having an internal lumen comprising a baffle having an upper chamber and a lower chamber, and the bearing housing having an upper recess for receiving a first bearing unit, and lower recess for receiving a second bearing unit;

an internal rotor comprising a turbine unit threadedly coupled to a mandrel, the turbine unit comprising a complimentary surface that is received by and terminates in the baffle's lower chamber, the turbine unit being primarily and rotatably housed within the internal lumen, the first bearing unit being interposedly positioned between the turbine unit and the first recess of the bearing housing, the mandrel having a base and a shaft, the shaft extending outwardly from the base and threadedly coupling the turbine unit, the second bearing unit being interposedly positioned between the base and the second recess of the bearing housing; and a fluid pathway extending through the drilling device, wherein a flow of a drilling fluid though the fluid pathway activates the turbine unit to cause activation of the internal rotor.

11. The device of claim 10, further comprising a third bearing unit interposedly positioned between the complimentary surface of the turbine unit and the baffle's lower chamber.

12. The device of claim 10, wherein the baffle further comprises a fluid channel for directing the drilling fluid to activate the turbine unit of the internal rotor.

13. The device of claim 10, wherein the fluid pathway provides the drilling fluid with a substantially unidirectional flow past the turbine unit and out of the mandrel.

14. The device of claim 13, further comprising a third bearing unit interposedly positioned between the turbine unit and the lower chamber.

15. The device of claim 10, wherein the upper chamber comprises a vessel for receiving the drilling fluid and directing the drilling fluid through a fluid channel to the turbine unit, wherein a bottom surface of the vessel is oblique to an axis of rotation of the turbine unit.

16. A method for manufacturing a drilling sub assembly, the method comprising:

providing a body casing having a first end, a second end and an internal lumen, the first end having a first set of threads for threadedly receiving a drill rod of a drilling rig, wherein the internal lumen houses a baffle having a lower chamber;

rotatably housing a turbine unit in the internal lumen of the body casing such that a complimentary surface of the turbine unit is received by and terminates in the baffle's lower chamber;

providing a bearing housing having a first end and a second end, the first end of the bearing housing having a first recess, and the second end of the bearing housing having a second recess;

inserting a first bearing unit into the first recess of the bearing housing;

threadedly coupling the first end of the bearing housing to the second end of the body casing, the first bearing unit being interposedly positioned between the first recess and the turbine unit;

inserting a second bearing unit into the second recess of the bearing housing;

providing a mandrel comprising a shaft extending outwardly from a base, the mandrel further having a fluid pathway extending though the shaft and base portions of the mandrel;

threadedly coupling the shaft of the mandrel to the turbine unit, the shaft portion of the mandrel being inserted through the bearing housing, wherein the second bearing unit is interposedly positioned between the base portion of the mandrel and the second recess of the bearing housing.

17. The method of claim 16, further comprising setting the first bearing unit to a desired load by tightening or loosening the threaded connection between the body casing and the bearing housing.

18. The method of claim 16, further comprising setting the second bearing unit to a desired load by tightening or loosening the threaded connection between the mandrel and the turbine unit.

19. The method of claim 16, wherein the baffle further comprises a fluid channel for directing a drilling fluid to activate the turbine unit and the threadedly coupled mandrel.

20. The method of claim 19, further comprising inserting a third bearing unit between the lower chamber of baffle and the complementary surface of turbine unit, wherein the third bearing unit enables free rotation of the turbine unit relative to a stationary position of the baffle, the body casing and the bearing housing.

* * * * *